United States Patent [19]

Arp et al.

[11] 3,935,978

[45] Feb. 3, 1976

[54] TICKET DISPENSING APPARATUS

[75] Inventors: Ewald A. Arp; Robert A. Arp, both of Hopkins; Gene S. Moody, Minneapolis, all of Minn.

[73] Assignee: Arnold W. G. Larson, Minneapolis, Minn. ; a part interest

[22] Filed: Feb. 3, 1975

[21] Appl. No.: 546,504

[52] U.S. Cl. ..... 225/15; 225/16

[51] Int. Cl.² ..... B26F 3/02

[58] Field of Search ..... 221/272, 274, 276, 71, 221/74; 225/11, 15, 32, 82, 10, 16

[56] References Cited

UNITED STATES PATENTS 2,636,691 4/1953 Fritzinger ..... 225/15 X

*Primary Examiner*—Stanley H. Tollberg

*Attorney, Agent, or Firm*—Merchant, Gould, Smith, Edell, Welter & Schmidt

[57] ABSTRACT

A housing having its interior divided into a supply chamber for a folded row of connected tickets and a dispensing chamber, and providing a discharge opening at one end for delivery of tickets. A feeding element in the dispensing chamber is operated by an actuator to feed the row of tickets toward the discharge opening. The actuator is movable between spaced feeding and holding positions and has an edge portion that holds the row of coupons or tickets against discharge movements when the actuator is in its holding position. A retarding arrangement applies frictional effort against the row of tickets to prevent free movement of the tickets during a portion of the feeding movement of the feeding element, and lessens the frictional effort or drag on the tickets when the actuator is moved to its holding position. A locking device is operable to lock the housing against opening and to lock the actuator against ticket releasing movement and to unlock the same selectively; and an adjustable tear blade-equipped guide member provides a portion of the discharge opening.

12 Claims, 6 Drawing Figures

FIG. 1
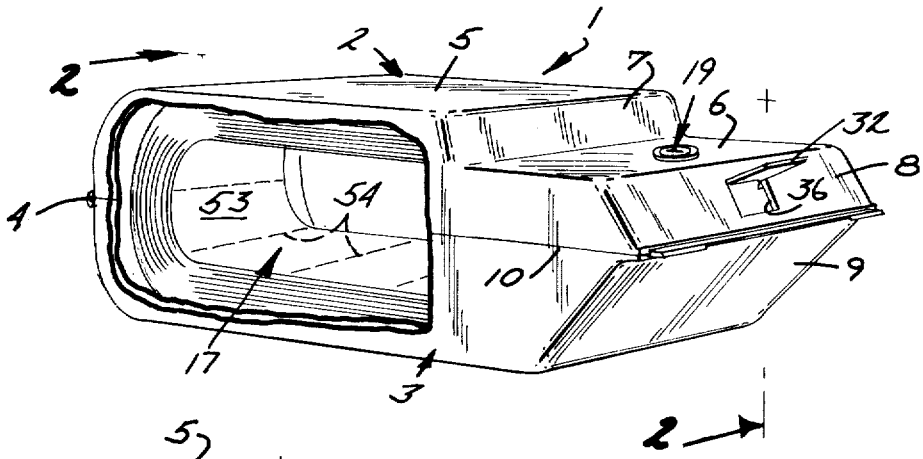
FIG. 2
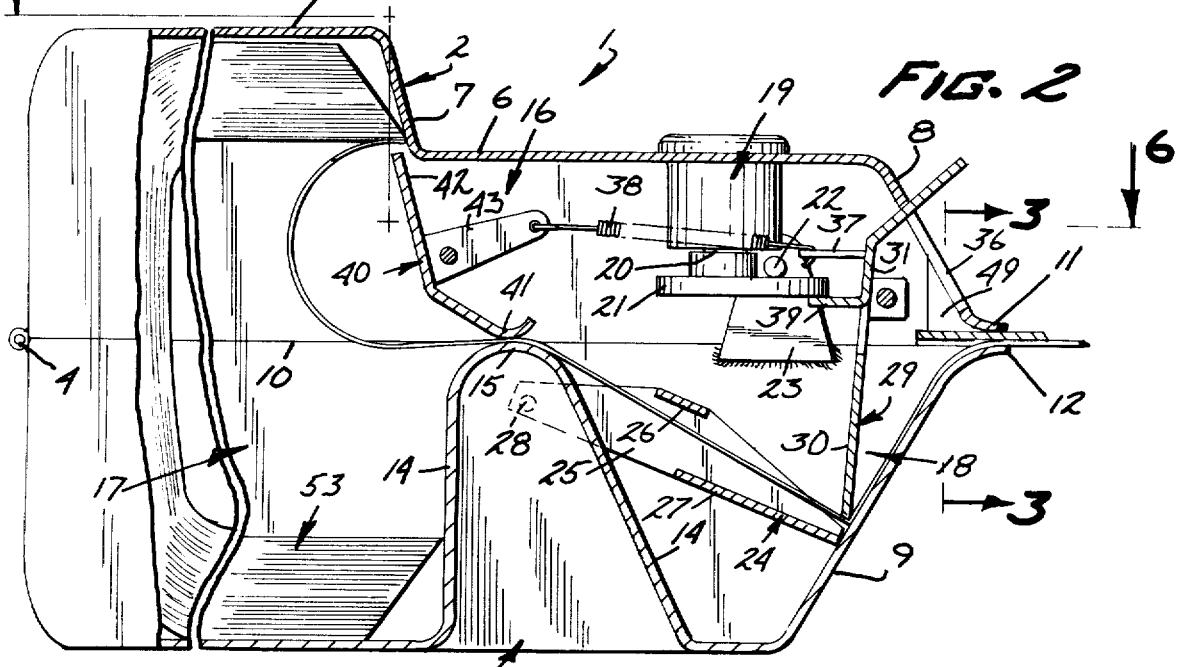
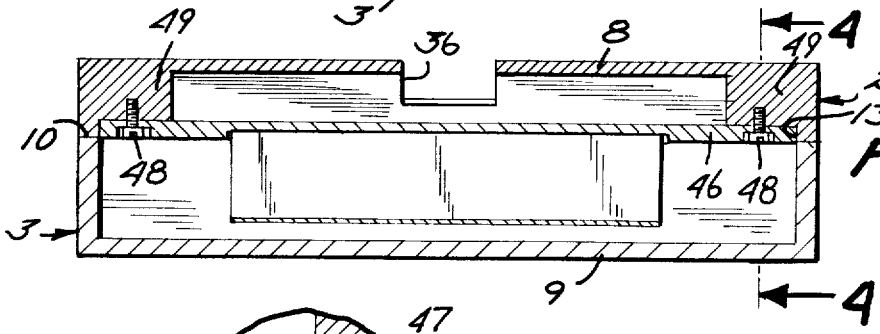
FIG. 3
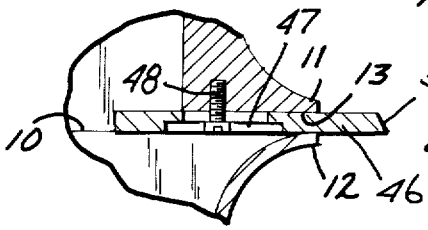
FIG. 4

TICKET DISPENSING APPARATUS

BACKGROUND OF THE INVENTION

This invention relates to the dispensing of tickets or coupons singly or in small quantities from a supply roll or stack of such articles, the tickets being connected in edge to edge relationship by perforated or otherwise weakened tear lines to provide an elongated row. When not disposed in rolls, the elongated rows are usually folded on given tear lines in accordian pleat fashion to provide a stack of superposed and connected rows, each row containing a predetermined number of tickets. The apparatus of this invention is adapted for use in dispensing lottery tickets or coupons such as are sold in several countries and in some States of this country.

SUMMARY OF THE INVENTION

An important object of this invention is the provision of an apparatus for dispensing tickets which simplifies the handling and dispensing of tickets and which holds a supply of tickets in orderly fashion.

Another object of this invention is the provision of a ticket dispensing apparatus which is simple and inexpensive to produce, which is highly efficient in its operation, and which may be easily adapted for use with tickets of various sizes.

To these and additional ends, which will hereinafter become apparent, we provide a housing which defines a supply chamber and a dispensing chamber spaced from the supply chamber and communicating with the exterior of the housing through a discharge opening. A ticket feeding element is pivotally mounted in the dispensing chamber for ticket feeding and return movements. An actuator is pivotally mounted in the dispensing chamber for movements in one direction to impart ticket feeding movement to the feeding element to feed the row of tickets toward the discharge opening, and in the opposite direction to impart return movements to the feeding element and to engage the row of tickets and hold the same against feeding movement to the discharge opening. A ticket feed retarder is movable within the housing to frictionally engage the row of tickets, and a spring is used with the feed retarder for imparting a yielding drag against feeding movement of the tickets outwardly through the discharge opening.

In a more specific sense, the invention includes a locking member movable between different positions to lock the housing against being opened, and selectively to lock the actuator against ticket feeding movements; and a guide member is removably and adjustably mounted in the housing, and defines portions of the discharge opening, the guide member including a cutting blade portion to aid in the severing of dispensed tickets from the row thereof.

DESCRIPTION OF THE DRAWINGS

FIG. 1 is a view in perspective of the ticket dispensing apparatus of this invention, some parts being broken away;

FIG. 2 is an enlarged view partly in side elevation and partly in section, taken generally on the line 2—2 of FIG. 1;

FIG. 3 is a fragmentary transverse section taken substantially on the line 3—3 of FIG. 2;

FIG. 4 is a further enlarged fragmentary section taken on the line 4—4 of FIG. 3;

DETAILED DESCRIPTION OF THE PREFERRED EMBODIMENT

Figure 5:
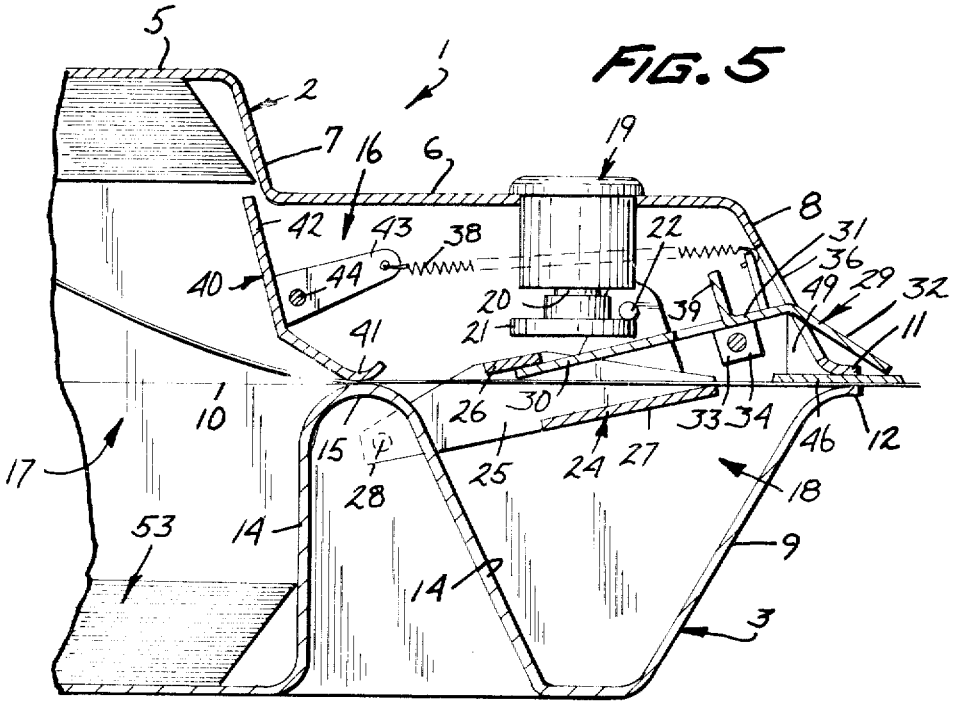
FIG. 5 is a view corresponding to a portion of FIG. 2, but showing a different position of some of the parts.

The apparatus of this invention is intended for use by persons engaged in the vending of coupons or tickets, such as lottery or sweepstakes tickets, and includes a housing, indicated generally at 1, and preferably of such size as to be easily carried about or set on a table or counter when in use, and stored in a relatively small place when not in use. The housing 1 comprises upper and lower housing sections 2 and 3 respectively, hinged together at one end, as indicated at 4. The upper housing section 2 is formed to provide relatively high and low top wall portions 5 and 6 respectively, these being connected by an angular wall portion 7. Opposite their hinge connected ends, the sections 2 and 3 are formed with angular end wall portions 8 and 9 respectively, the sections 2 and 3 having marginal edges which abut on a straight line, indicated at 10. Adjacent the abutting line 10, the end wall portions 8 and 9 are formed to provide out-turned lips 11 and 12 respectively, which cooperate to provide a slot-like opening 13. Longitudinally inwardly of the end wall portion 9, the lower housing section 3 is formed to provide a transverse partition 14 having a rounded top portion 15 disposed substantially at the level of the marginal edge of the lower housing section 3, see FIGS. 2 and 5. The partition 14 underlies the lower top wall 6 adjacent the connecting portion 7 thereof, and cooperates with the low top wall portion 6 to define a passageway 16. The parition 14 cooperates with the connecting wall portion 7 and that portion of the housing 1 therebetween and the hinged end 4 thereof to define a supply chamber 17; the partition 14 and that portion of the housing 1 therebetween and the end walls 8 and 9 cooperating to define a dispensing chamber 18 that communicates with the supply chamber 17 throught the passageway 16. The dispensing chamber 18 communicates with the exterior of the housing 1 by means of the slot-like opening 13.

Figure 6:
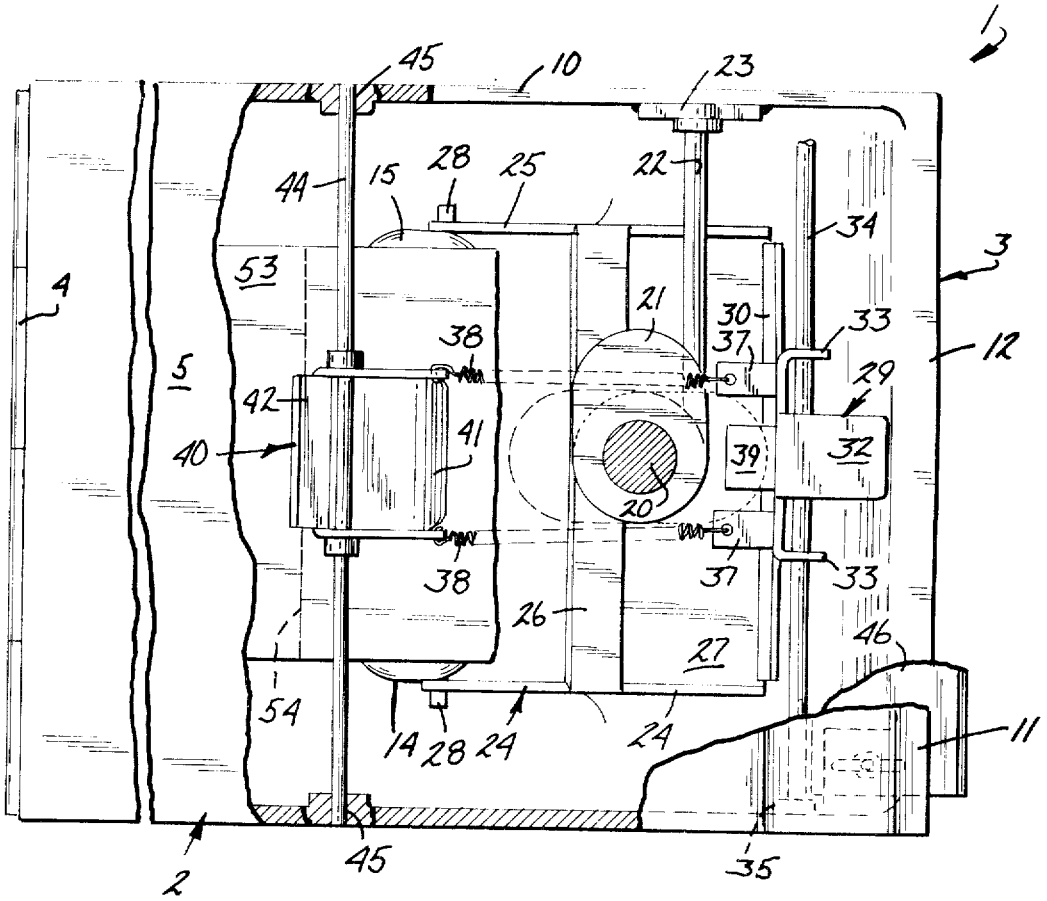
FIG. 6 is a view partly in plan and partly in section, taken generally on the line 6—6 of FIG. 2.

The housing sections 2 and 3 are releasably locked in a closed position shown in the drawings by means of a conventional key operated cylinder lock 19 suitably mounted in the low top wall portion 6, the lock 19 including a rotary spindle 20 and a plate-like bolt element 21 mounted on the spindle 20 for common rotary movement therewith. A strike element in the nature of an elongated pin or stud 22 is disposed in the upper portion of the dispensing chamber 18 and is supported therein, at one end, by a bracket 23 secured to and projecting upwardly from the lower housing section 3. The strike element 22 is disposed to have overlying engagement with the bolt element 21 to releasably lock the housing sections 2 and 3 together in given position of rotary movement of the bolt element 21. As shown in FIG. 6, the bolt element has locking engagement with the strike element 22 in positions shown by full and dotted lines. In a position of the lock bolt element 21, shown by dash lines in FIG. 6, the lock bolt element 21 is out of engagement with the strike pin or stud 22, so that the housing may be opened.

A ticket feeding element 24 comprises a pair of laterally spaced parallel side portions 25 connected by upper and lower cross plates 26 and 27 respectively. The side portions 25 are pivotally mounted on a pair of aligned stubshafts 28 that project laterally outwardly of opposite ends of the partition 14, see particularly FIG. 6. The ticket feeding element 24 is movable between a lowered ticket release position shown in FIG. 2, wherein the outer edge of the lower cross plate 27 engages the end wall portion 9, and a raised ticket feeding position, as shown in FIG. 5, wherein the upper and lower cross plates are positioned upwardly and downwardly respectively of the line 10 of abutment between the housing sections 2 and 3. The feeding element 24 is preferably gravity biased toward its lower position of FIG. 2.

Means for raising the feeding element 24 to its ticket feeding or release position of FIG. 5 comprises an actuator 29 having a plate-like lower portion 30, an intermediate portion 31 and an upper handle portion 32. The intermediate portion 31 is formed to provide a pair of laterally spaced ears 33 that are pivotally mounted on a transverse shaft 34 secured at its opposite ends in opposite sides of the upper housing section 2. One of the ends of the shaft 34 is shown as being so mounted by dotted lines in FIG. 6, and indicated at 35. The handle portion 32 projects outwardly through an opening 36 in the end wall portion 8 to be of easy access to the operator, so that the actuator 29 may be moved to a lower engaging and holding position shown in FIG. 2, and a raised position shown in FIG. 5 wherein the actuator 29 has engaged the cross-plate 26 of the feeding element 24 and raised the same to its ticket feeding or release position. The intermediate actuator portion 31 is further formed to provide a pair of laterally spaced fingers 37 that are each connected to a different one of a pair of coil tension springs 38 which yieldingly urge the actuator 29 toward its lowered ticket holding position of FIG. 2, as will hereinafter appear. The actuator 29 is further formed to provide a transverse lug 39 that is disposed to underlie the bolt element 21 when the actuator 29 is in its ticket-holding position of FIG. 2, and when the bolt 21 is in its dotted line position of FIG. 6. In the dotted line position of the bolt 21, the actuator 29 is positively held against movement away from its ticket-holding position, and the upper housing section is positively held against opening movement relative to the lower housing section 3. When the bolt element 21 is moved to its full line position of FIG. 6, the housing sections are still locked together, but the actuator lug 39 is released for swinging movement os the actuator between its lowered and raised positions.

A ticket retarding member 40 is disposed generally above the partition 14, and has a curved lower end portion 41 which overlies the arcuate upper end portion 15 of the partition 14. The member 40 further includes an upper end portion 42 that extends generally upwardly toward the top wall of the upper housing section 2. Intermediate its ends, the retarding member 40 is formed to provide a pair of elongated lugs 43 that extend generally toward the end wall portion 8 and which are journaled on a cross-shaft 44 that extends transversely of the housing and has its opposite ends mounted in the sidewalls of the upper housing section 2, as indicated at 45 in FIG. 6. The coil tension springs 38 extend from the fingers 37 of the actuator 29 and, as shown in FIGS. 2, 5 and 6, are connected to the free ends of the lugs 43. In this manner, the springs 38 not only yieldingly urge the actuator 29 toward its ticket holding position of FIG. 2 and toward engagement with the end wall portion 9 but also yieldingly urge the retarding member 40 toward engagement of the curved end portion 41 with the arcuate top portion 15 of the partition 14.

A plate-like guide member 46 is mounted in the opening 13 for movements in directions inwardly and outwardly of the opening 13, the guide member 46 having laterally spaced slots 47 for reception of mounting screws 48 that are screw threaded into second portions 49 of the end wall portion 8, see particularly FIGS. 3, 4 and 6, to releasably hold the guide member 46 in adjusted set positions of movement thereof. Intermediate its ends, the guide member 46 is formed to provide a downwardly opening groove 50 that cooperates with the bottom surface of the opening 13, or the top surface of the lip 12 to define a slot-like discharge opening 51. At its outer longitudinal edge, the guide member 46 is beveled, as indicated at 52 to define a sharp tear blade for tickets being dispensed.

An elongated row of tickets 53, connected together in edge-to-edge relationship by weakened tear lines or perforations 54, is disposed in accordian folded relationship to provide a plurality of superimposed layers, there being a plurality of tickets 53 in each layer thereof. The superimposed layers are bent into generally U-shape and inserted into the supply chamber 17, as shown particularly in FIGS. 1 and 2. The tickets are fed from the innermost layer over the arcuate portion 15 of the partition 14, between the cross plates 26 and 27 of the feeding element 24, and outwardly through the discharge opening 51, while the upper housing section 2 is in an open position. The upper housing section 2 is then closed and locked into place, the retarding member 40 engaging the row of tickets and pressing the same against the arcuate portion 15 of the partition 14, the plate-like portion 30 of the actuator 29 moving the underlying portion of the row of tickets 53 downwardly into engagement with the end wall portion 9 just above the cross-plate 27 of the feeding element 24. The lock 19 is manipulated to bring the bolt element 21 into underlying relationship with the strike pin 22, and into overlying relationship with the actuator lug 39 until such time as it is desired to dispense tickets 53 from the housing. At such time, the bolt element 21 is moved to its full line position of FIG. 6 after which the handle portion 32 of the actuator 29 is manually moved from its position of FIG. 2 to its position of FIG. 5, the lower edge portion of the actuator 29 engaging the cross-plate 26 of the feeding element 24 and raising the same to its position of FIG. 5. During upward movement of the feeding element 24, the cross-plate 27 engages the overlying portion of the row of tickets 53 and feeds the same toward and outwardly through the discharge opening 12. It should be noted that, as the actuator is moved toward its feeding element raised position, the springs 38 become stretched to increase pressure of the retarding member 40 against the tickets overlying the curved portion 15 of the partition 14, whereby to increase frictional drag on the tickets against outward movement through the discharge opening 51. The upward movement of the feeding element 24 is such that less than a full ticket is moved outwardly of the discharge opening 51. While holding the handle 32 depressed, the operator pulls out one or more tickets according to the purchaser's desires, until a given perforated line becomes even with the edge of the cutting blade 52. The operator then releases the actuator handle to reduce tension of the springs 38 and permit the actuator 29 and feeding element 24 to return to their positions of FIG. 2, while holding the exposed tickets against return movement in the housing. During downward movement of the actuator and feeding element, the loosened tension of the springs 38 against the retarding member 40 permits the actuator to draw tickets from the supply chamber 17. The operator severs the exposed tickets 53 from the row thereof, against the cutting blade portion 52, and the apparatus is then ready to dispense other tickets.

While we have shown and described a preferred embodiment of our ticket dispensing apparatus, it will be understood that the same is capable of modification without departure from the spirit and scope of the invention, as defined in the claims.

What is claimed is:

1. Ticket dispensing apparatus comprising:

a. a housing defining a supply chamber for a folded elongated row of tickets connected together in edge-to-edge relationship, and a dispensing chamber communicating with said supply chamber and defining a discharge opening;

b. a ticket feeding element mounted in said dispensing chamber for movement in one direction to feed tickets toward said discharge opening and alternately in an opposite retracting direction out of operative engagement with said tickets;

c. an actuator mounted in the housing for movement in one direction toward a feeding position to engage said feeding element and impart ticket feeding movement thereto, and in the opposite direction to a ticket holding position in engagement with said row of tickets to hold the same against feeding movement when said feeding element is retracted;

d. retarding means engaging said row of tickets to frictionally hold said tickets against free feeding movement;

e. and yielding means urging said actuator toward holding engagement with said tickets.

2. The apparatus defined in claim 1 in further combination with lock means for releasably locking said actuator in said ticket holding position thereof.

3. The apparatus defined in claim 1 in which said housing and retarding means define a passageway for said row of tickets substantially in alignment with said discharge opening, said feeding element engaging said tickets to move the same toward a substantially straight line path of travel between said passageway and discharge opening when moved by said actuator in sdaid one direction of movement thereof.

4. The apparatus defined in claim 3 in which said actuator comprises a plate-like portion for engagement with said feeding element to move the same in one direction of movement thereof, said plate-like portion having a ticket engaging edge for moving a portion of said row of tickets away from said substantially straight lines path of travel and into a bent position against a wall of said dispensing chamber angularly displaced from said path of travel when said actuator is moved to said ticket holding position thereof.

5. The apparatus defined in claim 1 characterized by a guide member mounted in said housing and defining a portion of said discharge opening, said guide member being adjustably movable longitudinally of the direction of travel of said tickets and having a transverse outer edge outwardly of the housing and providing a tear blade for said tickets.

6. The apparatus defined in claim 1 in which said housing comprises a pair of upper and lower housing sections hinged together for movements between open and closed positions relative to each other, said sections cooperating to define said supply and dispensing chambers and said discharge opening, characterized by lock means for releasably locking said sections in said closed positions thereof.

7. The apparatus defined in claim 6 in which said retarding means comprises a ticket engaging element in one of said housing sections, the other of said housing sections having an internal surface portion cooperating with said ticket engaging element to define a passageway for said row of tickets substantially in alignment with said discharge opening, said ticket engaging element being yieldingly urged toward the row of tickets therebetween and said internal surface portion.

8. The apparatus defined in claim 6 in which said ticket feeding element is pivotally mounted in said lower housing section for generally upward and downward movements toward and away from a generally straight line path of travel of said row of tickets between said supply chamber and said discharge opening, said actuator being pivotally mounted in said upper housing section on an axis parallel to the axis of pivotal movement of said coupon feeding element for movements between a position above said straight line path of travel and a ticket holding position wherein a ticket engaging portion of said actuator is disposed within said lower housing section, said lower housing section having a wall portion cooperating with said actuator portion to hold said row of tickets against discharge from the dispensing chamber.

9. The apparatus defined in claim 8 in which said retarding means comprises a fixed portion of said lower housing section between said supply and dispensing chambers, and a ticket engaging element mounted in the upper housing section for movements toward and away from said fixed portion and cooperating therewith to define a passageway substantially in alignment with said discharge opening and in said path of travel of the tickets, said yielding means comprising a spring having opposite ends connected to said ticket engaging element and said actuator and yieldingly urging said ticket engaging element toward said portion of the housing and said actuator toward its ticket holding position.

10. The apparatus defined in claim 9 in which said spring is so disposed relative to said actuator and said ticket engaging element that bias of the spring against said ticket engaging element is relatively greater when said ticket feeding element is moved to its feeding position by said actuator and relatively less when said actuator is moved to its ticket holding position.

11. The apparatus defined in claim 6 in which said lock means comprises a key operated locking member mounted in one of said housing sections for movements between spaced positions in said dispensing chamber, the other one of said housing sections and said actuator each having portions disposed for locking engagement with said locking member selectively.

12. The apparatus defined in claim 6 characterized by a guide member disposed in said upper housing section for movements longitudinally of the direction of movement of said row of tickets and having a channel defining portions of said discharge opening, and means for releasably locking the guide member in desired positions of said movements thereof, said guide member having an outer transverse edge providing a tear blade for said tickets.

* * * * *